US005700492A

United States Patent [19]

Morimoto et al.

[11] Patent Number: 5,700,492

[45] Date of Patent: Dec. 23, 1997

[54] ROTARY-TYPE TABLETTING MACHINE WITH LUBRICANT SPRAYING MEANS

[75] Inventors: Kiyoshi Morimoto; Yasushi Watanabe; Yoshika Sanada; Teiichi Miwa; Tomoaki Masada, all of Shizuoka, Japan

[73] Assignee: Kyowa Hakko Kogyo Co., Ltd., Tokyo, Japan

[21] Appl. No.: 332,533

[22] Filed: Oct. 31, 1994

[30] Foreign Application Priority Data

Nov. 1, 1993 [JP] Japan ..... 5-273304

[51] Int. Cl.[6] ..... B28B 21/00

[52] U.S. Cl. ..... 425/100; 264/130; 264/DIG. 37

[58] Field of Search ..... 264/130, DIG. 37; 425/421, 423, 149, 222, 100

[56] References Cited

U.S. PATENT DOCUMENTS 4,373,888 2/1983 Yamamoto ..... 425/149
4,617,191 10/1986 Nowak ..... 425/222

FOREIGN PATENT DOCUMENTS 41-11273 6/1966 Japan .

*Primary Examiner*—Jan H. Silbaugh
*Assistant Examiner*—Mark Eashoo
*Attorney, Agent, or Firm*—Jones, Tullar & Cooper, P.C.

[57] ABSTRACT

A rotary-type tabletting machine with lubricant spraying means, wherein a turn table has plural penetrated holes comprising dies provided at fixed intervals in a ring-like arrangement, each hole is provided with a pair of punches above and under the hole, each pair of punches is rotated together with the turn table and execute piston operation so that tablets are continuously produced by compressing pharmaceutical material filled in the die. The rotary-type tabletting machine is provided with a spraying chamber with an upper open end for inserting an upper punch and enclosing the die when the turn table moves to a rotation position which is after a rotation position where a molded table is discharged and before a rotation position where pharmaceutical material is filled in the die. A spray connected with the spraying chamber sprays lubricant in the spraying chamber, and pulsating air generating means connected with the spraying chamber diffuses. The lubricant sprayed in the spraying chamber.

3 Claims, 8 Drawing Sheets

ROTARY-TYPE TABLETTING MACHINE WITH LUBRICANT SPRAYING MEANS

FIELD OF THE INVENTION

The present invention relates to an improvement of a rotary-type tabletting machine with lubricant spraying means wherein drug tablets are continuously produced. More particularly it relates to a rotary-type tabletting machine with an automatic spray for spraying lubricant uniformly on an upper punch, a lower punch, and a die when pharmaceutical material Is compressed and tabletted as drug tablets so as to heighten the quality of the tablet.

PRIOR ART

Conventionally, of tabletting machines of the type noted have been proposed In JP-P-41-11273 and JP-A-56-14098.

According to the tabletting machine in JP-P-41-11273, material m to be compressed and tabletted is filled in a die 2e of a turn table 1e as shown in FIG. 7(*b*) and the material m is compressed and tabletted as drug tablets by means of an upper punch 3e and a lower punch 4e as shown in FIG. 7(*c*).

Lubricant K is sprayed from a nozzle 60 for spraying lubricant against the lower punch surface 31 of the upper punch 3e and against an upper punch surface 41 of the lower punch 4e as shown in FIG. 7(*a*) before the material is filled in the die.

According to the tabletting machine In JP-A-56-14098, lubricant K in a feeder for fine powdered lubricant 50 provided above a die 2e is fed to a lubricant supplier 51. The lubricant K is fed inside of the die 2e as shown in FIG. 8(*a*) and placed on an upper punch surface 41 of a lower punch 4e as shown in FIG. 8(*b*). Then, compressed air is injected from a nozzle 61 provided in a spraying chamber 52 into the lower punch 4e. The lubricant K on the lower punch 4e is blown away upwardly to be diffused and the diffused lubricant adheres to the inside surface 21 of the die 2e and the lower punch surface 31 of the upper punch 3e.

Such a tabletting machine of outer lubricant spray type doesn't need to mix the lubricant with the material m. Further, the problem whereby the material m adheres to the upper punch 3e, the lower punch 4e or other parts can be prevented. Therefore, the quality of the tablets can be improved.

However, in the conventional tabletting machine (FIG. 7), the lubricant K is injected in the vertical direction from the nozzle 60 provided above the die 2e. According to such a mechanism, the lubricant K can't be sprayed uniformly against the inside surface 21 of the die 2e positioned in the same direction as the injecting direction of the lubricant K.

The attached lubricant is dense In the center of the surface to which the lubricant K is sprayed, on the other hand, the attached lubricant of the outer surface thereof is less dense. Therefore, it is difficult to spray the lubricant K uniformly to the lower punch surface 31 of the upper punch 3e and the upper punch surface 41 of the lower punch 4e.

On the other hand, according to the tabletting machine of FIG. 8, the lubricant K provided on the lower punch 4e positioned in the die 2e is diffused in the spraying chamber 52 by means of compressed air. The lubricant K can be efficiently diffused against the inside surface 21 of the die 2e.

However, it is difficult to diffuse the lubricant K deposited on the lower punch 4e in the spraying chamber 52 uniformly only by blowing air from the nozzle 61. Especially, it is more difficult to diffuse the lubricant K on the lower punch 4e against the lower punch surface 31 of the upper punch 3e which is positioned above the turn table 1e at the same rate as the lubricant K is sprayed against the lower punch 4e.

Therefore, the material m sticks on parts of the tabletting machine because of non-uniform spraying of the lubricant and that causes poor quality of the tablets. In this respect, the conventional tabletting machine has much room for improvement.

SUMMARY OF THE INVENTION

The present invention is proposed to solve the above-mentioned problems. The object of the present invention is to spray lubricant uniformly on an upper punch, a lower punch, and a hole comprising a die when pharmaceutical material Is compressed and tabletted as drug tablets by a rotary-type tabletting machine and to improve the quality of the tablets.

The present invention is an improvement of a rotary-type tabletting machine with lubricant spraying means wherein a turn table has plural penetrating holes comprising dies provided at fixed intervals In ring-like configuration, each hole being provided with a pair of punches above and under the hole, each pair of punches are rotated together with the turn table and execute piston operation so that tablets are continuously produced by compressing pharmaceutical material filled in the die.

A spraying chamber with an upper open end for inserting an upper punch and enclosing the die when the turn table moves to a rotation position which is after a rotation position where a compressed tablet is discharged and before a rotation position where pharmaceutical material is filled in the die. A spray for spraying lubricant in the spraying chamber and pulsating air generating means for diffusing the lubricant sprayed in the spraying chamber are provided for the spraying chamber.

According to a further improved rotary-type tabletting machine with lubricant spraying means of the present invention, pulsating air generating means supplies negative pulsating air to the spraying chamber so as to suck and discharge extra lubricant sprayed from the spray into the pulsating air generating means by means of negative pulsating air. According to another improved rotary-type tabletting machine with lubricant spraying means, pulsating air generating means supplies positive pulsating air to the spraying chamber provided with a suction pipe connected with a blower so as to suck and discharge extra lubricant sprayed from the spray through the suction pipe.

According to the present invention, a lubricant spraying or diffusing chamber (enclosure) is provided in one of the rotatable positions such as one which a turn table reaches at the time of discharging a compressed tablet from the die until the time for filling the die with the next batch of drug material. The lubricant diffusing chamber is designed to insert the upper punch thereinto from the upper portion of the chamber having the upper end thereof opened for enclosing the whole of the die, and a lubricant spraying means for spraying a lubricant in the diffusing chamber and a pulsating air generating means for diffusing the lubricant sprayed in the diffusing chamber additionally connected to the chamber.

Incidentally, In the case of the rotary-type tabletting machine of the kind described, the rotatable positions having the aforesaid lubricant diffusion chamber therein, because the positions are taken after the upper punch has been lifted up and has discharged the tablet by lifting the tablet by use of the lower punch, the upper punch is positioned above the die and the lower punch is positioned above the interior of the die.

Accordingly, when the turn table in the rotated position described above and if the spraying chamber is set for the upper punch to be inserted into the lubricant diffusion chamber from the upper end opening, the diffusion chamber encloses the upper punch and die as shown in FIGS. 1 and 5, and the other lower punch stays in the die, so that the lubricant sprayed inside the diffusion chamber is not leaked outside of the upper and inner punch and over the whole of the die scheduled to be filled with the drug material.

According to the tabletting machine wherein negative pulsating air is supplied in the spraying chamber, the negative pulsating air can draw lubricant efficiently from the spraying means and diffuse the lubricant in the spraying chamber so as to enhance attachment of the lubricant on the lower punch and the die wall. Further, the pulsating air also sucks and discharges extra lubricant into the pulsating air generation means. (See FIG. 1)

According to the tabletting machine wherein positive pulsating air is supplied in the spraying chamber, the positive pulsating air can also draw lubricant efficiently from the spraying chamber and diffuse the lubricant in the spraying chamber so as to enhance attachment of the lubricant on the lower punch and the die wall. (See FIG. 5)

DETAILED DESCRIPTION OF THE PREFERRED EMBODIMENTS

Figure 1:
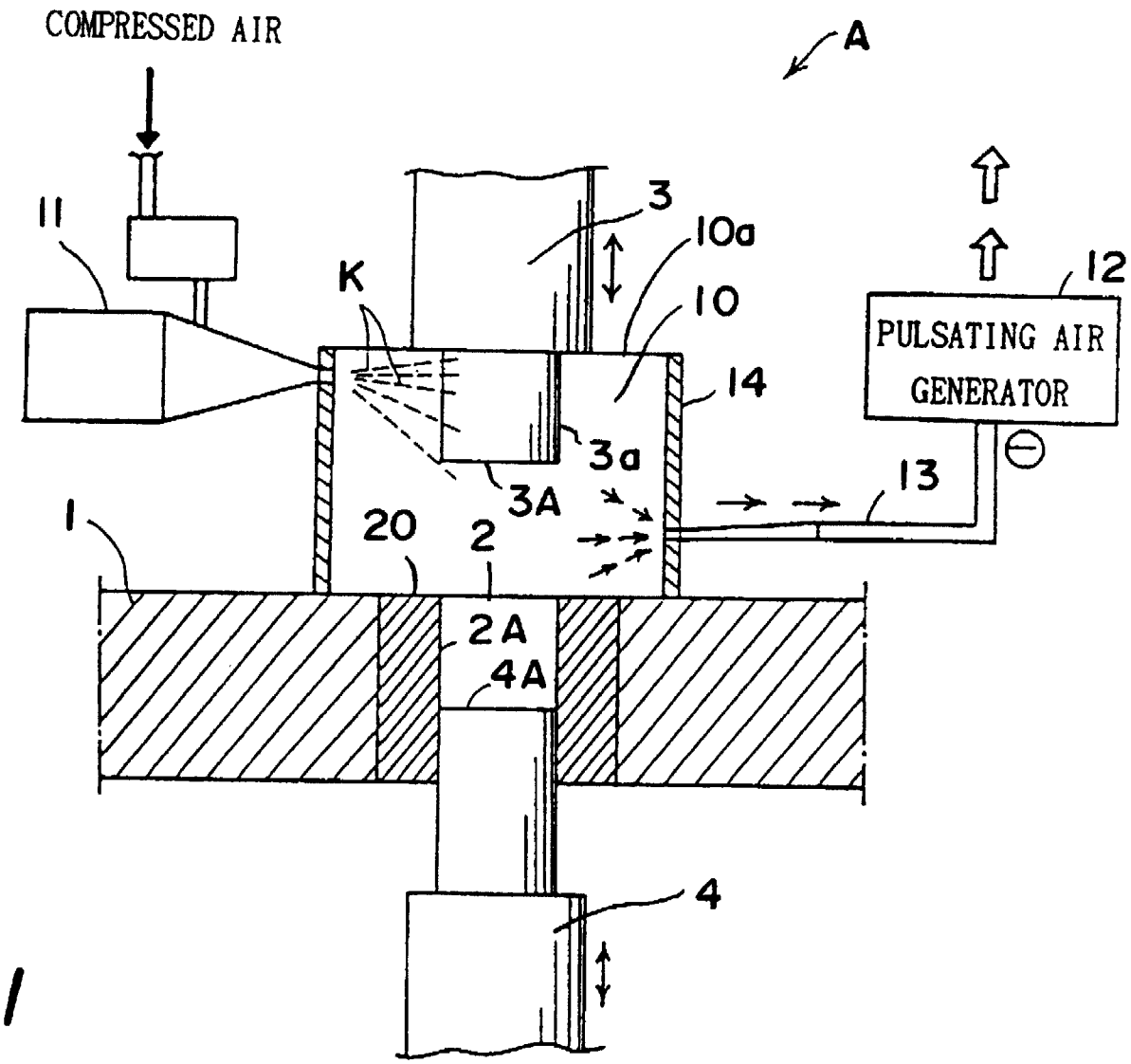
FIG. 1 is a partially enlarged sectional view of one embodiment of the tabletting machine of the present invention.
Figure 2:
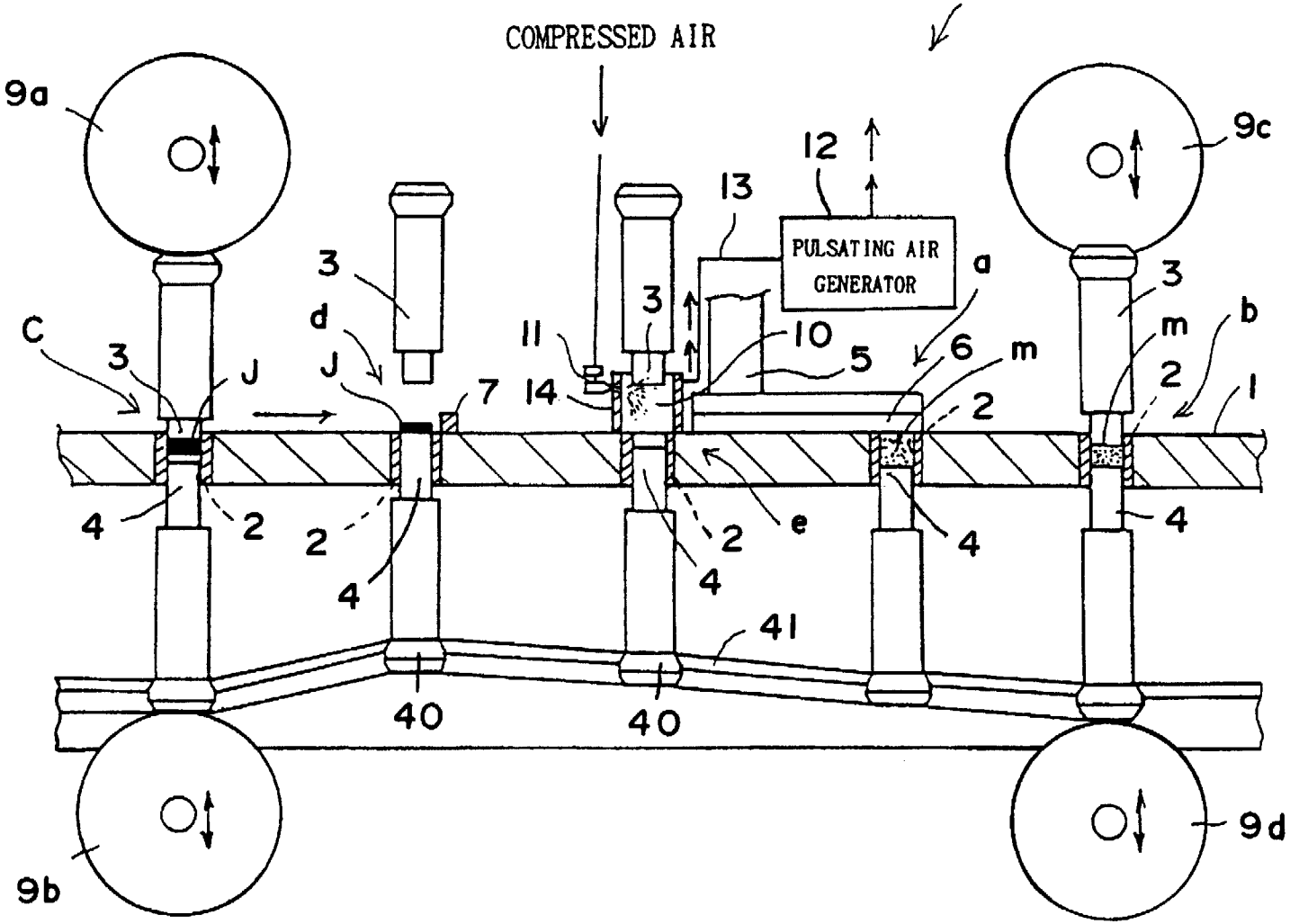
FIG. 2 is a diagrammatic front section of an embodiment of the tabletting machine of the present invention.
Figure 3:
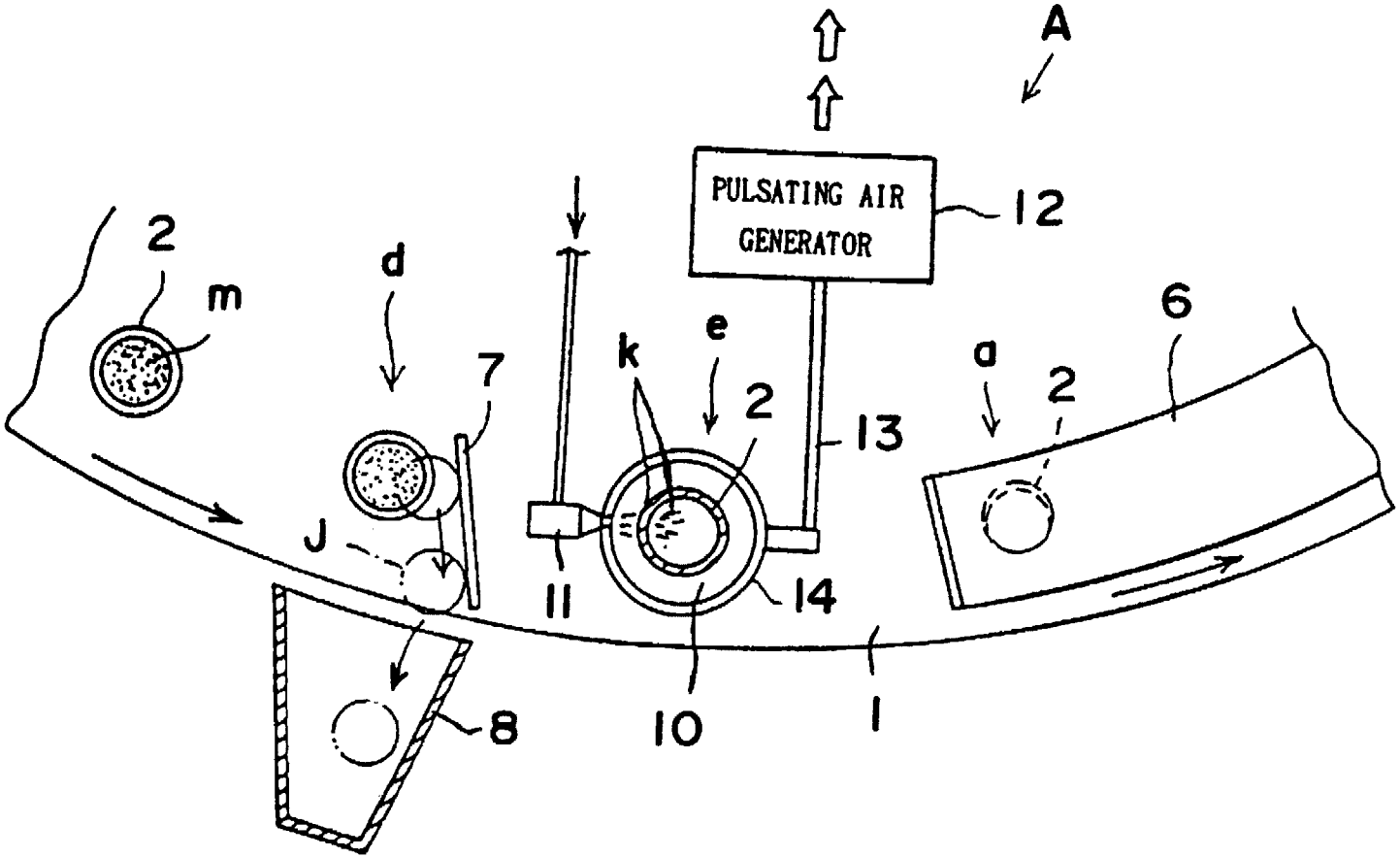
FIG. 3 is a diagrammatic partial plan view of one embodiment of the tabletting machine of the present invention.

FIGS. 1–3 show one embodiment of the tabletting machine A according to the present invention. FIG. 1 is a partial enlarged sectional view, FIG. 2 is a diagrammatic front sectional view, and FIG. 3 is a plan sectional view.

Plural through holes comprising dies 2 are provided in a turn table 1 at a fixed pitch in ring-like configuration. The turn table 1 is like a disk and can be rotated horizontally. An upper punch 3 and a lower punch 4 are provided for each die 2, the punches 3 and 4 opposing each other as shown in FIGS. 2 and 3.

The upper punches 3 and the lower punches 4 are designed to execute piston operation by means of a cam mechanism comprised of lower punch head cams 40 and cam grooves 41 which rotate with the turn table 1. Pharmaceutical material m filled in the dies 2 at a rotation position where material m is fed is compressed by the upper punch 3 and the lower punch 4, tabletted as a drug tablet J and discharged at a discharge position. By repeating such operations, tablets are continuously produced.

When the die 2 reaches a rotation position a, the pharmaceutical material m is filled in the die 2 from a material supply chute 5 and a feed chute 6. While the die 2 moves from a rotation position b to a rotation position c, the material m is compressed by means of the upper punch 3 and the lower punch 4 and compressed into a tablet J. (The positions b and c are continuation of each other.)

When the lower punch 4 is raised at a rotation position d, the tablet J is also raised upward. Then the tablet J touches a scraper 7 fixed at a certain position and is discharged into a discharge chute 8 provided at the side of the turn table 1.

The numerals 9*a* and 9*b* in FIG. 2 show rollers for controlling the striking pressure of the punches on the material m, and 9*c* and 9*d* show rollers for controlling the pre-striking pressure. The height of the upper punch 3 and the lower punch 4 which touch the rollers 9*a*–9*d* can be accurately adjusted by controlling the height of the rollers 9*a*–9*d*, thereby accuracy in the size of the tablet J is heightened.

A cylindrical enclosure 14 of which the upper end 10*a* (FIG. 1) is open is provided at a rotation position e which is after the position d where the tablet J is discharged and which is before the position a where the pharmaceutical material m is filled in the die 2. The enclosure 14 forming a spraying chamber 10 is provided with a lubricant spray 11 and a pulsating air generator 12.

The cylindrical enclosure 14 comprising a spraying chamber 10 provided so as to enclose an upper circumference 20 of the die 2 and the lower end 3*a* of the punch 3 provided above the die 2 (FIG. 1). At the position where the spraying chamber 10 is provided, the lower punch 4 is designed to be as low as possible in the die 2. Preferably the lower punch 4 reaches its dead-end of vertical piston operation.

Any spray can be applied as far as it sprays a desired lubricant K in the spraying chamber 10 by means of air pressure. A spray of a cartridge type, pressure tank type or mini-hopper type can be used.

Magnesium Stearate, Calcium Stearate, or Talc can be used as lubricant K. The kind of lubricant K can be selected according to the quality and so on of pharmaceutical material m.

The pulsating air generator 12 is connected with the spraying chamber 10 via a conduit pipe 13. Pulsating air of negative pressure can be transmitted to the spraying chamber 10 through the conduit pipe 13.

Figure 4A:
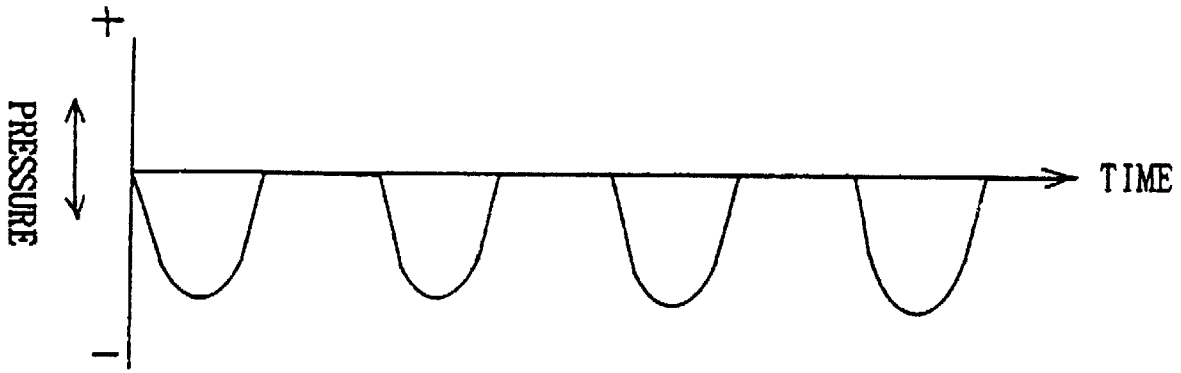
FIGS. 4(*a*) and 4(*b*) show negative pulsating air.
Figure 4B:
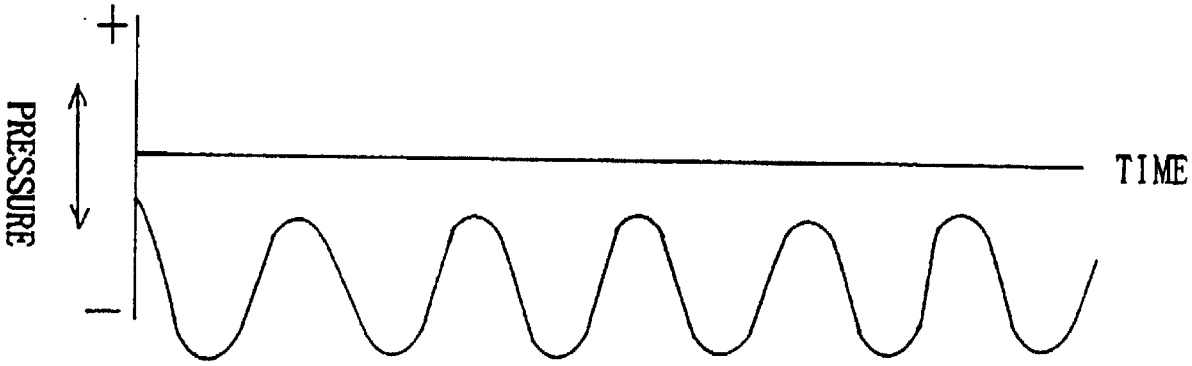

The pulsating air generator 12 sucks air in the spraying chamber 10 intermittently at fixed intervals through the conduit pipe 13 and produces pulsating air having the pressure wave shape of FIG. 4(*a*). A pulsating air generator which repeats suction of air in the spraying chamber 10 and stoppage of the suction by means of a blower is applied as the pulsating air generator 12.

Pulsating air with the pressure wave shape of FIG. 4(*b*) wherein pressure changes while negative pressure is kept may be produced.

The operation of the tabletting machine A constructed as mentioned above will be explained hereinafter.

The plural dies 2 . . . move one after another according to the rotation of the turn table 1. When a die 2 reaches the position e, shown in FIG. 2, where the spraying chamber 10 is provided, the lubricant K is sprayed in the spraying chamber 10 by feeding compressed air to the lubricant spray 11. At this time, pulsating air with negative pressure produced in the pulsating air generator 12 is fed into the spraying chamber 10. The pulsating air may be always fed in the spraying chamber 10.

When the pulsating air is fed in the spraying chamber 10, air vibration is caused all over the chamber 10.

The particle of the lubricant K sprayed in the spraying chamber 10 is forced to be diffused in the chamber 10 by the air vibration.

As a result, the lubricant K is sprayed uniformly so as to adhere on the striking surface (upper punch surface 4A) of the lower punch 4, the inner die wall 2A of the die 2 and the striking surface (lower punch surface 3A) of the upper punch 3.

The extra lubricant K in the spraying chamber 10 is sucked into the pulsating air generator 12 through the conduit pipe 13 and discharged out of the chamber 10. Therefore, accumulating a large amount of lubricant K deposits on the surface of the turn table 1 can be prevented and a suitable amount of the lubricant K can be sprayed on the upper surface 4A of the lower punch 4 and so on.

If the lubricant K is sprayed uniformly on suitable places of the upper punch 3, lower punch 4 and the die 2, as mentioned above, the material m is prevented from strongly adhering to such parts and a tablet of high quality can be tabletted when the material m is filled in the die 2 and compressed by the upper punch 3 and the lower punch 4.

The above-mentioned embodiment is constructed such that pulsating air of negative pressure, shown in FIGS. 4(*a*) and 4(*b*), is fed in the spraying chamber 10. However, the present invention isn't limited to such construction.

Figure 5:
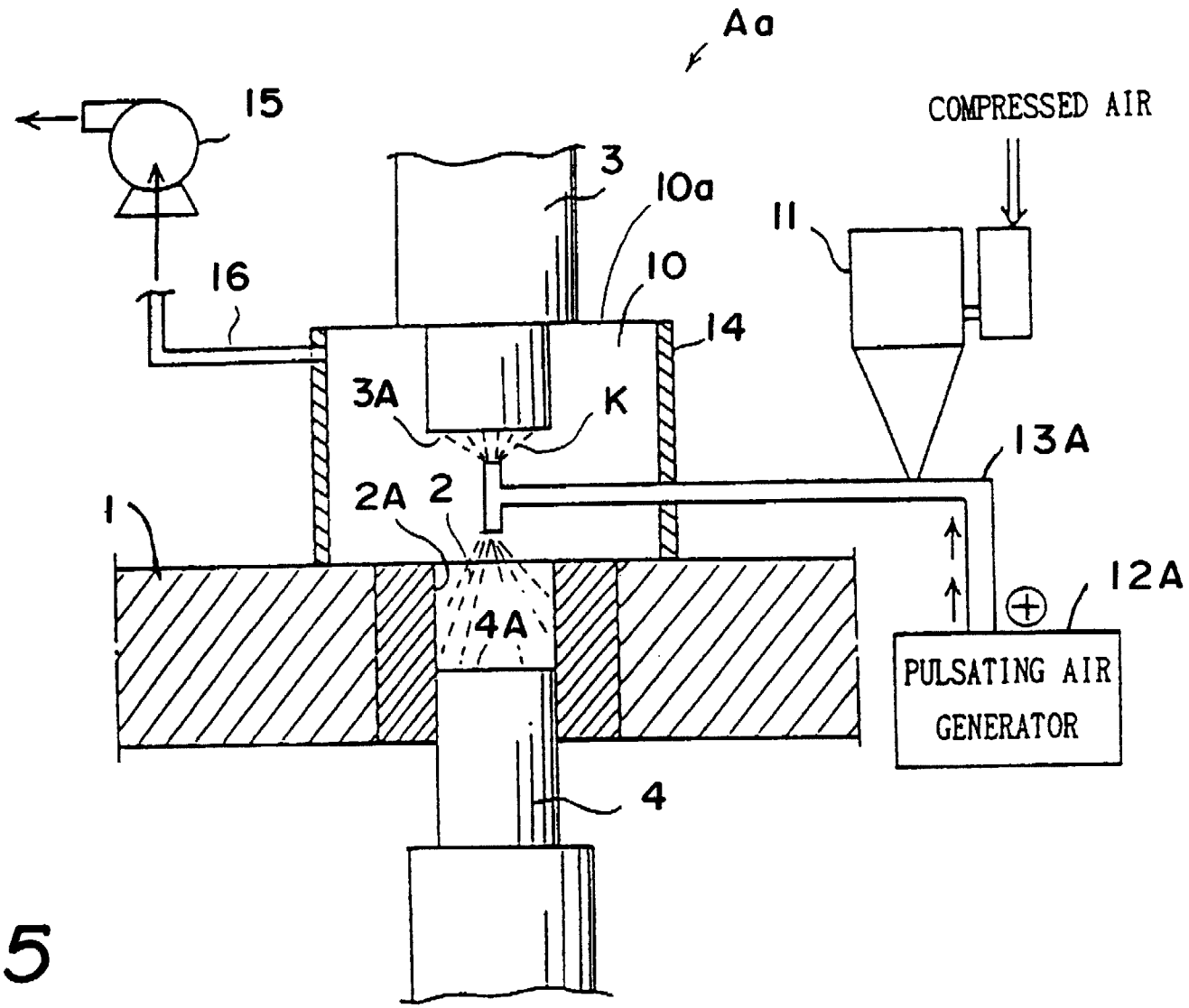
FIG. 5 shows a partially enlarged sectional view of another embodiment of the tabletting machine of the present invention.

FIG. 5 shows a partially enlarged section of another embodiment Aa of the tabletting machine according to the present invention.

According to the tabletting Machine Aa, a pulsating air generator 12A is connected to a spraying chamber 10 via a conduit pipe 13A. The tabletting Machine Aa is also constructed such that a lubricant spray 11 is provided for the conduit 13A so that lubricant K is sprayed in the chamber 10 through the conduit 13A.

A blower 15 to discharge air in the spraying chamber 10 is connected with the chamber 10 via a pipe 16.

Figure 6A:
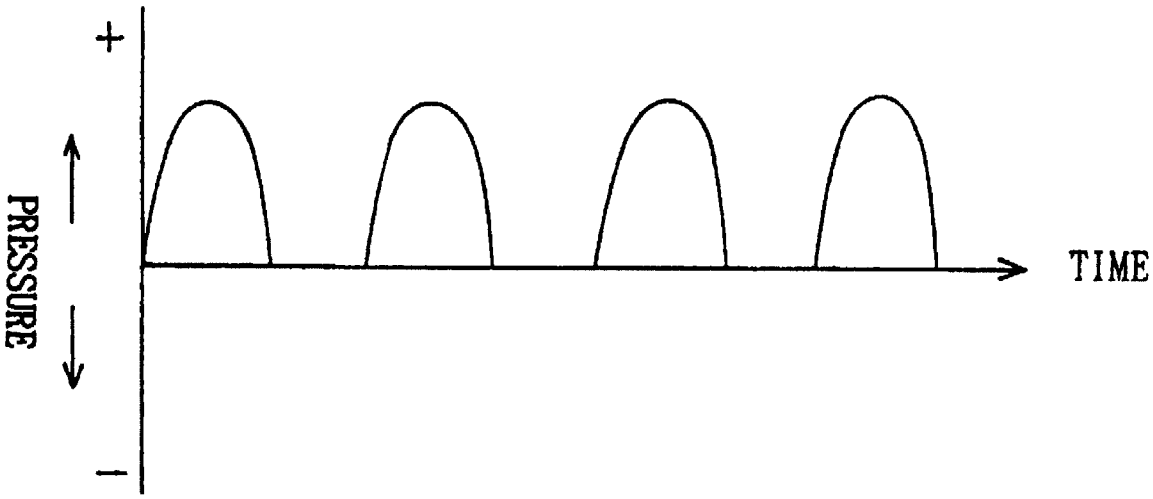
FIGS. 6(*a*) and (*b*) show positive pulsating air.
Figure 6B:
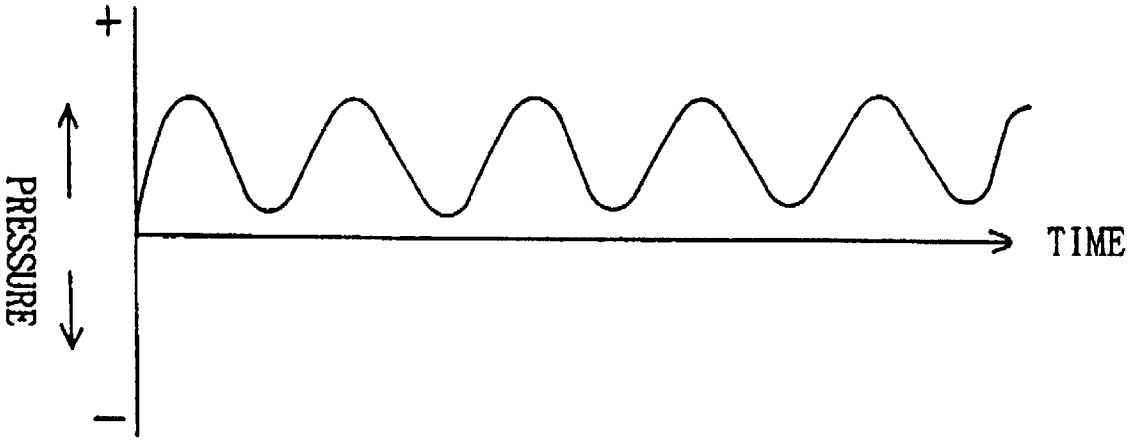
Figures 7A, 7B, 7C:
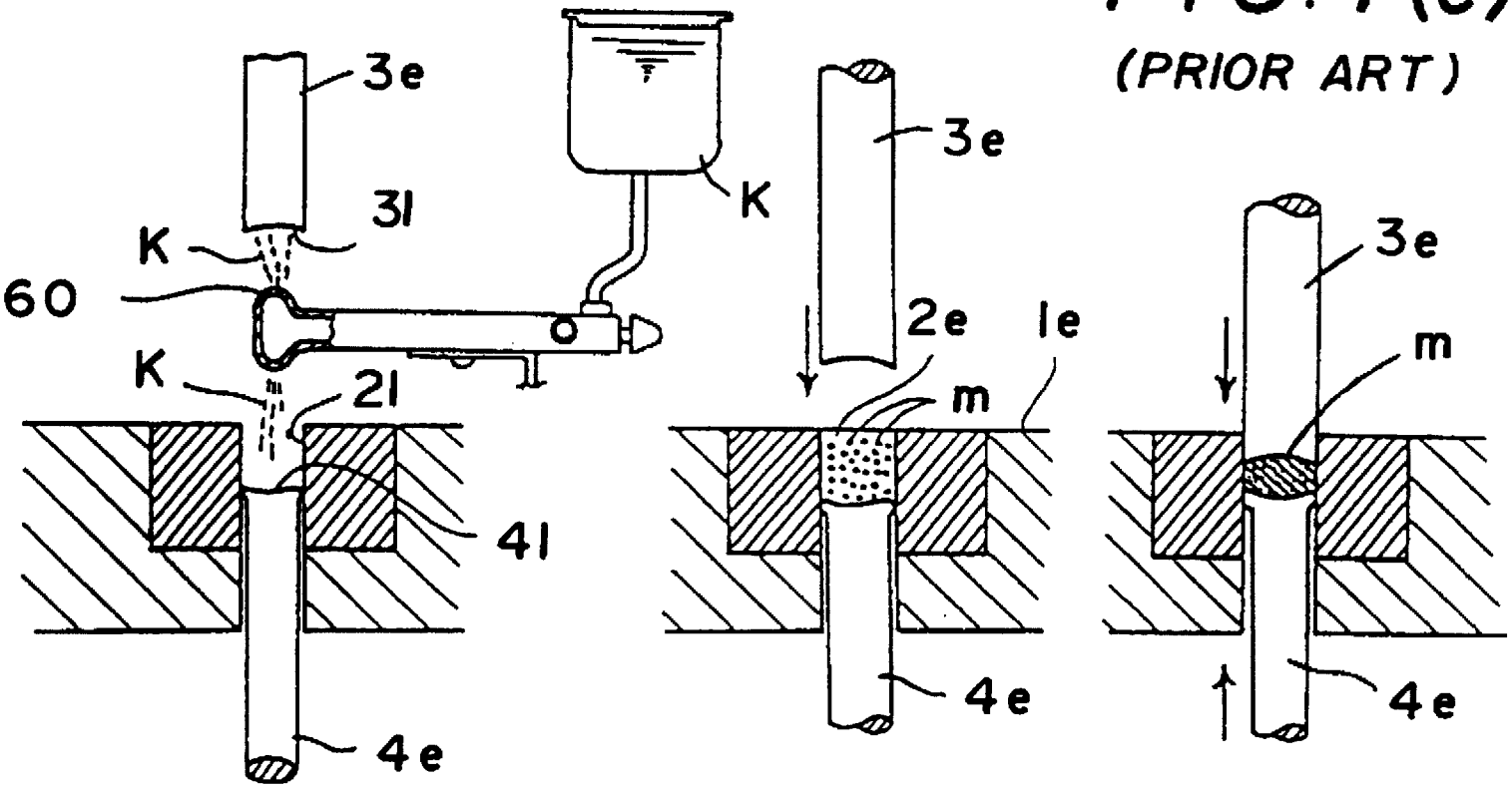
FIG. 7(a) (PRIOR ART)
FIG. 7(b) (PRIOR ART)
FIG. 7(c) (PRIOR ART)
FIGS. 7(*a*), 7(*b*) and 7(*c*) are partial sections showing one embodiment of a conventional tabletting machine of the outer spray type.
Figures 8A, 8B, 8C:
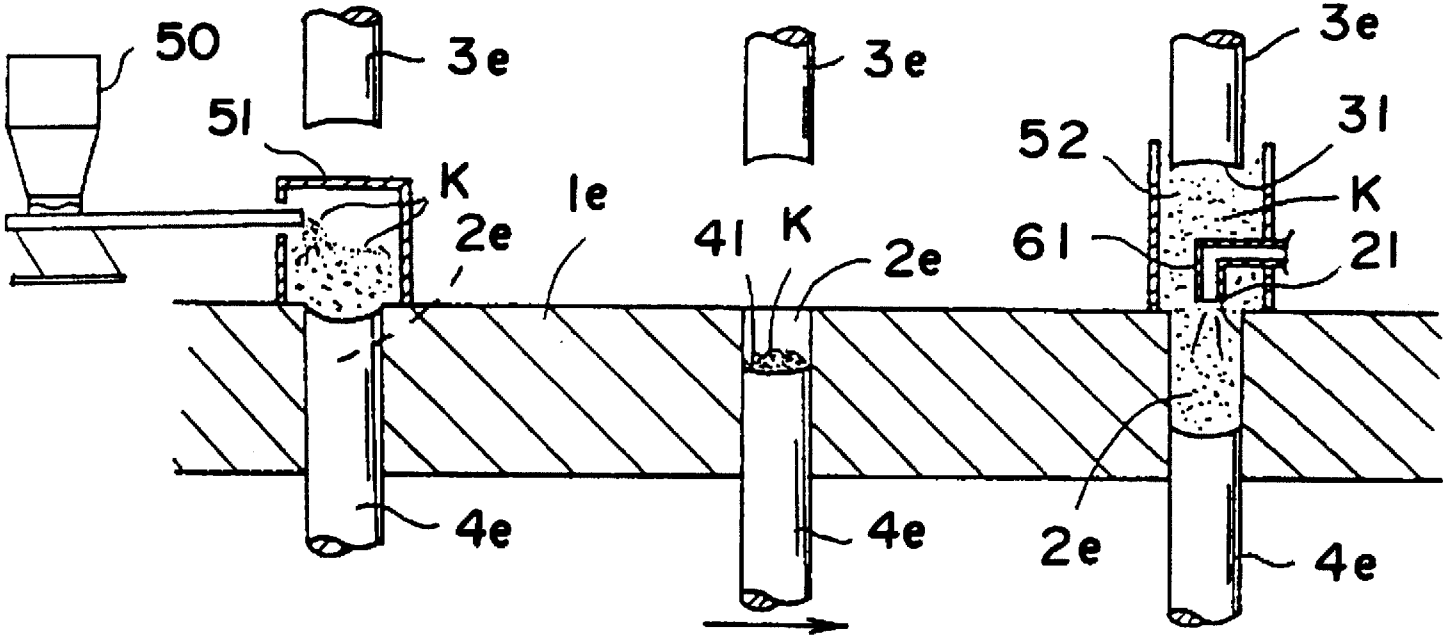
FIG. 8(a) (PRIOR ART)
FIG. 8(b) (PRIOR ART)
FIG. 8(c) (PRIOR ART)
FIGS. 8(*a*), 8(*b*) and 8(*c*) are partial sections showing other embodiments of a conventional tabletting machine of the outer spray type.

According to the tabletting machine Aa, pulsating air of positive pressure, of which pressure wave shape is shown in FIGS. 6(*a*) or 6(*b*), is generated by operating the pulsating air generator 12A. The lubricant K sprayed into the conduit pipe 13A from the lubricant spray 11 is supplied into the spraying chamber 10 together with the pulsating air. The lubricant is forcedly diffused all over the spraying chamber 10 by means of air vibration supplied therein. Extra lubricant K is discharged out of the chamber 10 by the blower 15.

Therefore, a suitable amount of the lubricant K can be uniformly sprayed on an upper punch surface 4A of a lower punch 4, and an inner die wall 2A of a die 2 and a lower punch surface 3A of an upper punch 3, like the embodiment of FIG. 1.

According to the present invention, either pulsating air of positive pressure or that of negative pressure can be fed in the spraying chamber 10, as mentioned above.

Pulsating air with low frequency such as 10 Hz is preferable, but the frequency isn't limited in the present invention.

Also in the present invention, material quality and kind of material m aren't limited. The present invention can be utilized for tabletting or producing many kinds of tablets such as powdered or granular medicine, foodstuff, metal and so on.

According to the present invention, lubricant sprayed in the spraying chamber can be forcedly diffused all over the spraying chamber by air vibration caused by pulsating air. It can be understood that lubricant can be uniformly sprayed on desired places such as an upper punch, a lower punch and an inner die wall of a die c thereby improving the quality of tablets, compared to the conventional means wherein lubricant is only sprayed or lubricant placed on a lower punch blown by air.

What is claimed is:

1. A rotary tabletting machine, comprising: a turn table defining a plurality of rotation positions, said turn table having a plurality of penetrated holes each comprising a die provided at fixed intervals in a ring arrangement; each die, provided with a pair of punches, each pair of punches situated above and below its respective die, each pair of punches being rotated together with the turn table and adapted to execute a piston operation so that tablets are continuously produced by compressing pharmaceutical material filled in each die associated with each pair of punches executing the piston operation;

a spraying chamber with an upper open end for inserting an upper punch of any one of each pair of punches and enclosing each die associated with said upper punch of each pair of punches when said turn table moves to a rotation position which is after a rotation position where a compressed tablet is discharged and before a rotation position where pharmaceutical material is filled in each die associated with said upper punch of each pair of punches;

lubricant spraying means connected with said spraying chamber for spraying lubricant in said spraying chamber, said lubricant spraying means continuously supplying lubricant in said spraying chamber; and pulsating air vibration generating means connected with said spraying chamber, for feeding compressed air to said spraying chamber for diffusing the lubricant sprayed in said spraying chamber, said pulsating air vibration generating means supplying oscillating energy of low frequency which is enough to periodically change the pressure in said spraying chamber so as to disperse the lubricant sprayed in said spraying chamber to attach the lubricant uniformly to each die and each associated pair of punches.

2. A rotary tabletting machine as set forth in claim 1, wherein said pulsating air vibration generating means supplies negative pulsating air to said spraying chamber so as to suck and discharge extra lubricant sprayed from said lubricant spraying means into said pulsating air vibration generating means by means of negative pulsating air.

3. A rotary tabletting machine as set forth in claim 1, wherein said pulsating air vibration generating means supplies positive pulsating air to said spraying chamber and said spraying chamber is provided with a suction pipe connected with a blower, so as to suck and discharge extra lubricant sprayed from said spray through said suction pipe.

* * * * *